US007740449B1

(12) United States Patent
Brown et al.

(10) Patent No.: US 7,740,449 B1
(45) Date of Patent: Jun. 22, 2010

(54) PROCESS FOR ADJUSTING A FLOW CAPACITY OF AN AIRFOIL

(75) Inventors: Barry J Brown, Jupiter, FL (US); Frank W Huber, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 686 days.

(21) Appl. No.: 11/698,380

(22) Filed: Jan. 26, 2007

(51) Int. Cl.
*F01D 5/14* (2006.01)

(52) U.S. Cl. ..... 416/1; 416/223 A; 416/243; 415/1; 415/191

(58) Field of Classification Search ..... 416/1, 416/223 A, 243, DIG. 2, DIG. 5; 415/1, 415/191
See application file for complete search history.

(56) References Cited

U.S. PATENT DOCUMENTS

| | | | | |
|---|---|---|---|---|
| 2,746,672 | A | 5/1956 | Doll, Jr. et al | |
| 2,801,790 | A | 8/1957 | Doll, Jr. | |
| 4,504,189 | A | 3/1985 | Lings | |
| 4,624,104 | A | 11/1986 | Stroem | |
| 4,664,594 | A | 5/1987 | Mandet et al. | |
| 4,726,101 | A * | 2/1988 | Draghi et al. | 29/889.1 |
| 4,741,667 | A | 5/1988 | Price et al. | |
| 4,968,216 | A * | 11/1990 | Anderson et al. | 415/199.5 |
| 5,174,715 | A * | 12/1992 | Martin | 415/209.4 |
| 5,299,909 | A | 4/1994 | Wulf | |
| 5,326,221 | A | 7/1994 | Amyot et al. | |
| 5,931,636 | A | 8/1999 | Savage et al. | |
| 6,109,869 | A | 8/2000 | Maddaus et al. | |
| 6,604,285 | B2 * | 8/2003 | Burdgick | 29/889.22 |
| 6,709,237 | B2 * | 3/2004 | Tiemann | 416/97 R |
| 6,726,447 | B2 | 4/2004 | Lutz | |
| 6,799,948 | B2 * | 10/2004 | Ito et al. | 416/223 A |
| 7,048,509 | B2 * | 5/2006 | Tominaga et al. | 416/223 A |
| 2007/0283679 | A1 * | 12/2007 | Pesyna et al. | 60/204 |

* cited by examiner

*Primary Examiner*—Igor Kershteyn
(74) *Attorney, Agent, or Firm*—John Ryznic

(57) ABSTRACT

A process for adjusting a throat area (the flow capacity) between airfoils in an airfoil configuration such as a stator ring used in a small gas turbine engine. The airfoils are designed with an over-extending trailing edge forming a throat area sized such that a worst case tolerances design flow area would be achieved. A fluid with a flow rate representing the actual fluid for normal operation in the airfoil configuration is passed through the airfoil throats and the flow rate is measured. A specified portion of the leading edge of each airfoil is removed until the design flow rate through the airfoil configuration is achieved. A plurality of iterations of measuring flow rates and removing trailing edge material is performed until the design flow rate is achieved.

8 Claims, 2 Drawing Sheets

PROCESS FOR ADJUSTING A FLOW CAPACITY OF AN AIRFOIL

BACKGROUND OF THE INVENTION

1. Field of the Invention

The present invention relates generally to a turbomachine, and more specifically to adjusting the flow capacity between airfoils in a turbomachine.

2. Description of the Related Art Including Information Disclosed Under 37 CFR 1.97 and 1.98

A turbomachine, such as a compressor and a turbine, especially for those used in a gas turbine engine, include one or more stages of rotor blades in which each stage includes a stage of stator vanes or guide vanes located upstream of the rotor blades to guide the airflow into the rotor blades. In a gas turbine engine, the compressor is designed for a certain flow rate through the engine. The turbine is also designed to receive the flow rate from the compressor for maximum efficiency. The flow rate through a turbine is controlled by the throat area between adjacent stator vanes. In order to provide the highest efficiency for the engine, the flow rate through the turbine should be coordinated with the flow rate that the compressor and combustor would put out. If the turbine throat area is too large, the efficiency of the engine will drop. If the throat area is too small, pressure upstream of the turbine will increase and cause compressor surge which will also decrease the efficiency of the engine.

The prior art U.S. Pat. No. 6,109,869 issued to Maddaus et al on Aug. 29, 2000 and entitled STEAM TURBINE NOZZLE TRAILING EDGE MODIFICATION FOR IMPROVED STAGE PERFORMANCE discloses a process for altering the throat areas by cutting back selected portions of the trailing edge of the partitions in order to minimize or eliminate interaction of the tip and hub vortices in the hot steam flow path or to reduce additional secondary aerodynamic flow losses (see column 2, line 46 of this patent). The Maddaus patent addresses changing the radial distribution of the airfoil throat area (as shown in FIG. 6 of this patent) in order to increase stage performance.

Another prior art process, that of U.S. Pat. No. 4,741,667 issued to Price et al on May 3, 1988 and entitled STATOR VANE, discloses varying the stator vane throat area in order to achieve a radial distribution of throat area while keeping a straight airfoil leading/forward edge section for the purpose of using inserts within the airfoil. According to the Price et al patent, "a stator vane configuration is provided with a chordal dimension varying over the span of the vane from a maximum value proximate the vane midspan and decreasing radially inwardly and outwardly therefrom. When arranged in a stage with a circumferentially distributed plurality of similarly configured vanes, the vane configuration according to the present invention achieves a radially varying nozzle throat size for inducing a greater working fluid mass flow adjacent the radially inner and outer vane ends. The flow modification thus induced results in a more desirable working fluid axial velocity profile entering the downstream rotor stage." See column 2, lines 47-59 in this patent.

In a medium to large gas turbine engine, the turbine stator vanes are cast with such a tolerance that the throat area is generally within the range to provide the proper flow capacity for high efficiency of the engine. In a typical gas turbine engine of this class, airfoil tolerance requirements are set such that the resulting effective throat areas are within about 2% to 3% of the intended design. However, in a small gas turbine engine, because the airfoils (blades and vanes) are so thin, the tolerances of these small airfoils could result in throat areas that far exceed the flow design levels and result in poor engine performance.

It is therefore an object of the present invention to provide for a small gas turbine engine that has a flow capacity close to the design parameters for a high efficiency engine.

It is another object of the present invention to shape an airfoil such a smooth relation exists between removal of trailing edge material and effective flow area.

BRIEF SUMMARY OF THE INVENTION

The present invention is a process for adjusting the throat areas of airfoils that are used in a small gas turbine engine. The airfoils could be stator vanes or rotor blades used in the turbine, or diffuser vanes used downstream from a centrifugal compressor. The airfoils are small and thin such that the tolerances are large enough to form throat areas too large or too small for the most efficiency operation. The airfoils are designed to have a smaller effective flow area than required such that the worst case tolerances design flow area would be achieved. To achieve this, the airfoils are design with longer chords. The airfoil configuration is flow tested using the appropriate fluid to pass through the throat areas of the airfoil configuration. The flow capacity for airfoil configuration is measured and compared to the design target. The throat area is then enlarged by removing a portion of the trailing edge of each of the airfoils until the design flow level is achieved. The process of measuring the flow rate and then removing trailing edge material is repeated until the desired flow rate is achieved.

DETAILED DESCRIPTION OF THE INVENTION

The present invention is a process for adjusting the flow capacity (or, throat area) of adjacent airfoils used in a small turbomachine such as a gas turbine engine. The airfoils defining the throat areas could be the stator vanes or the rotor blades in a turbine, or the diffuser vanes used in the centrifugal compressor. Also, by small airfoils, the present invention defines small airfoils to be airfoils that are so small that the acceptable tolerances in the airfoils would create unacceptable tolerances in the throat areas.

Figure 1:
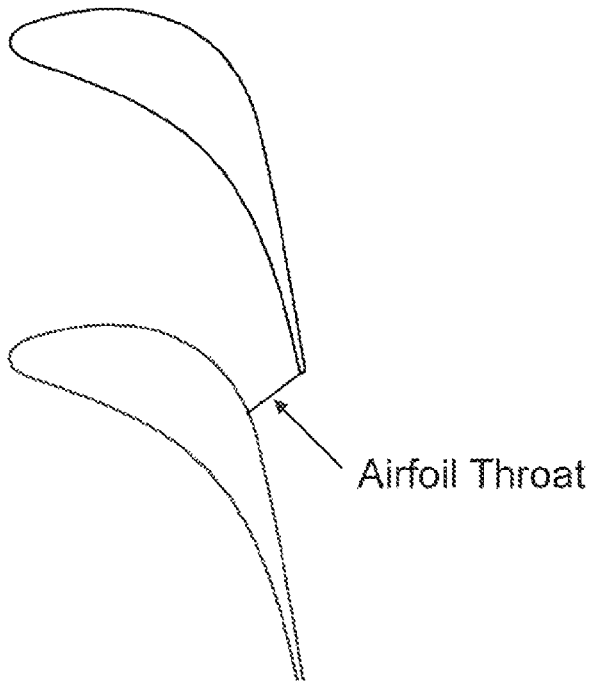
FIG. 1 shows a cross section of a top view of two adjacent airfoils defining a throat area used in the present invention.
Figure 3:
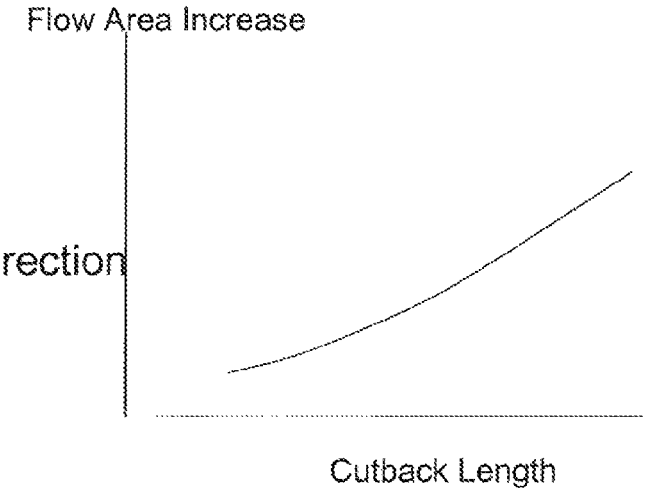
FIG. 3 shows a graph of the flow area increase versus the cutback length for the adjacent airfoils of the present invention.
Figure 4:
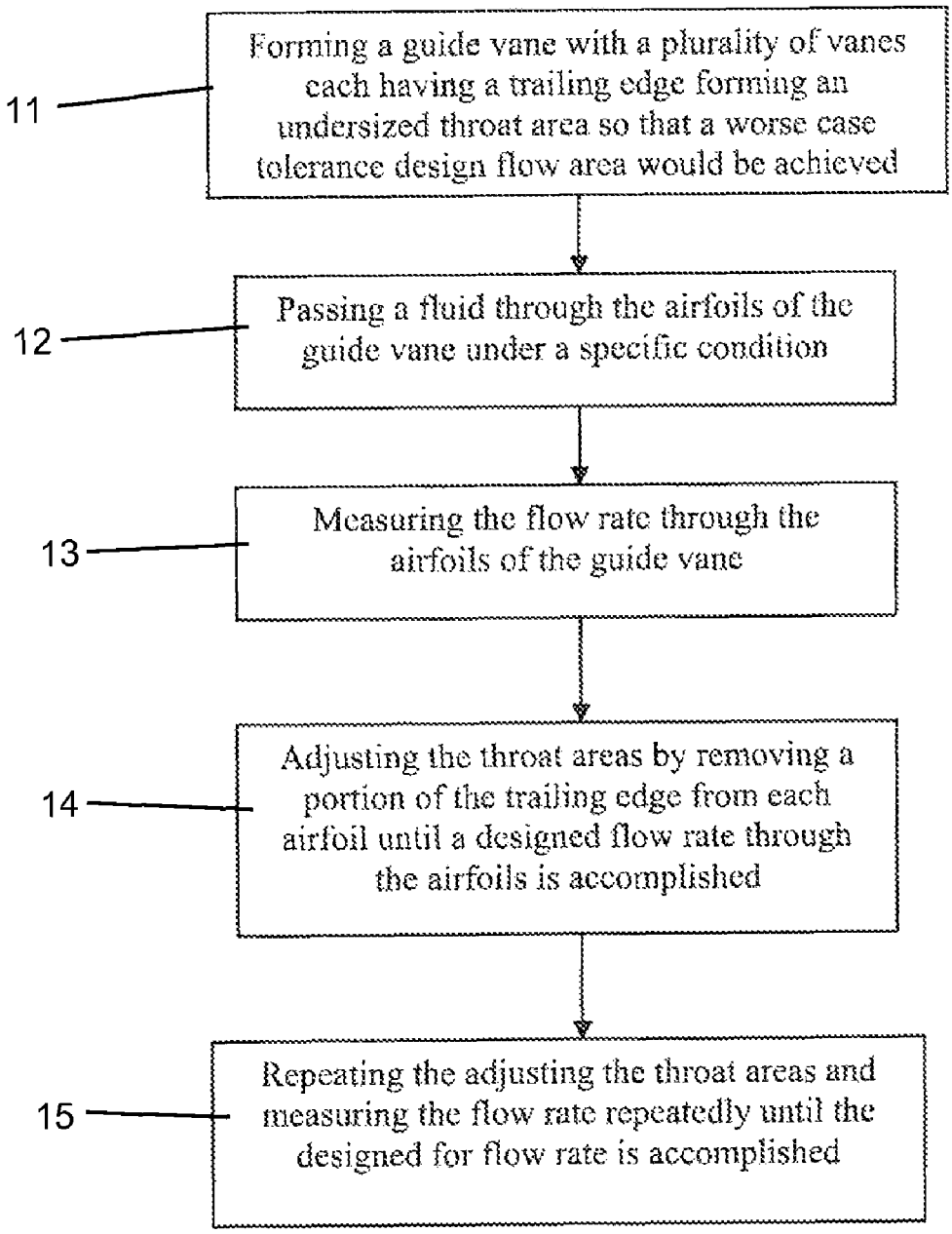
FIG. 4 shows a process for adjusting for adjusting a throat area between adjacent airfoils in a guide vane of the present invention.

FIG. 1 shows a cross section view of two adjacent airfoils used in the present invention that define a throat area between them. The throat area is the shortest distance formed between the opposing walls of the adjacent airfoils. Each airfoil is design to have a longer chord such that the throat area would be of such size that the worst case tolerances for design flow areas would be achieved. The airfoils are designed to have longer chords and the airfoil with such a shape that when material is removed from the trailing edge, the exit direction of the flow would be substantially the same. The airfoil contour is constructed such that as the airfoil trailing edge is cutback, its effective flow area increases smoothly and efficiently as represented on the graph in FIG. 3 and in step 11 in FIG. 4.

Figure 2:
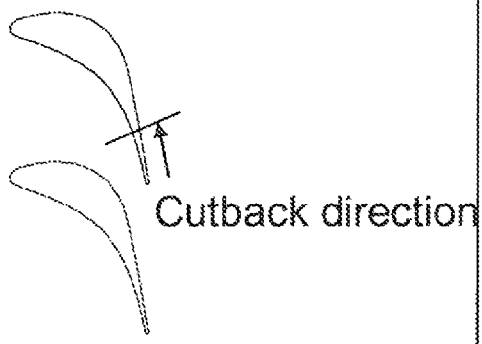
FIG. 2 shows a cross section view of the top of two adjacent airfoils of the present invention with some of the trailing edge of each airfoil removed to increase the throat area.

In a small gas turbine engine, the stator vane set is generally going to be a one piece disk with the airfoils extending between annular inner and outer shrouds. The stator vane set would then be placed in a flow measuring apparatus in which a fluid would be passed through the throats formed in the vane set (step 12). A measurement of the flow through the vane configuration is made (step 13) and a portion of the trailing edge of each of the airfoils would be removed (FIG. 2, step 14 in FIG. 4) until the proper flow rate for vane configuration is found. Since the airfoil has a shape such that the flow rate varies smoothly with removal of the leading edge material (see FIG. 3), the anticipated change in flow rate can be estimated from the graph to reach the design flow rate for the vane configuration. Several interactions of the step of removing a portion of the trailing edge and measuring the resulting flow rate is performed before the design flow rate is achieved within a certain degree of error (step 15).

The airfoil throat areas formed in the turbine rotor disks can also be adjusted by the process of the present invention. Also, a centrifugal compressor includes a vane diffuser located at the exit end of the compressor to diffuse the flow before entering the combustor. The diffuser vane could also adjust the individual throat areas using the process of the present invention.

In summary, the gas turbine flow capacity and velocity triangles are mainly controlled by the minimum distance between airfoils (the airfoil throat area) and the pressure loss generated by the airfoils. For small turbo-machines, tolerances can result in significant variation in the minimum distance relative to the design intent. These same manufacturing tolerances can also result in significant differences in airfoil pressure loss relative to design. These effects can result in a design with a significantly difference in flow capacity relative to design intent. This flow capacity miss will cause the engine to operate at non-optimum conditions. The process of the present invention will minimize this effect. The airfoils are designed with throat areas smaller than design intent. Once procured, the airfoils are tested by passing the appropriate fluid through the airfoils. Measured flow capacity is then compared to design intent. The airfoil is then modified by cutting back the trailing edge a prescribed distance parallel to the existing trailing edge. A key component of this process is designing the basic airfoil shape such that its flow area increases smoothly and efficiently as the airfoil is cutback.

We claim the following:

1. A process for adjusting a throat area formed between adjacent airfoils in an airfoil configuration, the airfoil configuration including an annular arrangement of airfoils, the process comprising the steps of:

forming each airfoil with a trailing edge having an undersized throat area;

passing a fluid through the airfoil configuration under a specified condition;

measuring the flow rate though the airfoil configuration; and, adjusting the throat areas until a predetermined flow rate through the airfoil configuration is accomplished.

2. The process for adjusting a throat area of claim 1, and further comprising the step of:

adjusting the throat area by removing a portion of the trailing edge from each of the airfoils forming the throat area.

3. The process for adjusting a throat area of claim 2, and further comprising the step of:

forming each airfoil throat area such that a worst case tolerances design flow area would be achieved.

4. The process for adjusting a throat area of claim 3, and further comprising the step of:

the predetermined flow rate is the designed flow rate for the throat area.

5. The process for adjusting a throat area of claim 4, and further comprising the step of:

the step of adjusting the throat area includes the steps of adjusting the throat area and measuring the flow rate repeatedly until designed for flow rate is accomplished.

6. The process for adjusting a throat area of claim 1, and further comprising the step of:

forming each airfoil throat area such that a worst case tolerances design flow area would be achieved.

7. The process for adjusting a throat area of claim 1, and further comprising the step of:

the predetermined flow rate is the designed flow rate for the throat area.

8. The process for adjusting a throat area of claim 1, and further comprising the step of:

The step of adjusting the throat area includes the steps of adjusting the throat area and measuring the flow rate repeatedly until designed for flow rate is accomplished.

* * * * *